US008203244B2

(12) United States Patent
Marioni

(10) Patent No.: US 8,203,244 B2
(45) Date of Patent: Jun. 19, 2012

(54) SUPPORT FOR FIXING AN ELECTRICAL MOTOR TO A TUB OF A WASHING MACHINE OR SIMILAR HOUSEHOLD APPLIANCE

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 393 days.

(21) Appl. No.: 12/208,444

(22) Filed: Sep. 11, 2008

(65) Prior Publication Data

US 2009/0096305 A1 Apr. 16, 2009

(30) Foreign Application Priority Data

Sep. 11, 2007 (IT) ..... MI2007U0304

(51) Int. Cl.
*H02K 7/118* (2006.01)
*H02K 21/22* (2006.01)
*H02K 11/04* (2006.01)

(52) U.S. Cl. ..... 310/91; 310/67 R; 310/64

(58) Field of Classification Search ..... 310/91, 310/67 R, 64, 216, 156.26, 218, 261, 68 R; *H02K 3/24, 7/118, 1/27, 21/22, 11/04*
See application file for complete search history.

(56) References Cited

U.S. PATENT DOCUMENTS

| | | | | |
|---|---|---|---|---|
| 4,668,898 | A * | 5/1987 | Harms et al. | 310/67 R |
| 6,291,912 | B1 * | 9/2001 | Nadir et al. | 310/64 |
| 6,396,190 | B1 * | 5/2002 | Ahn et al. | 310/261 |
| 7,166,950 | B2 * | 1/2007 | Kim et al. | 310/261 |
| 2006/0208604 | A1 * | 9/2006 | Marioni | 310/261 |
| 2007/0063603 | A1 | 3/2007 | Levine et al. | |

FOREIGN PATENT DOCUMENTS

| | | |
|---|---|---|
| EP | 0750064 A1 | 12/1996 |
| EP | 1691470 A1 | 8/2006 |
| EP | 1696070 A1 | 8/2006 |
| WO | 0055414 | 9/2000 |
| WO | 0070138 | 11/2000 |
| WO | 0070139 | 11/2000 |

* cited by examiner

*Primary Examiner* — Quyen Leung
*Assistant Examiner* — Michael Andrews
(74) *Attorney, Agent, or Firm* — Akerman Senterfitt

(57) ABSTRACT

A support (200) is described for fixing an electric motor (3) to a tub (6) of a washing machine (1) or similar household appliance. The electric motor (3) is of the type with external rotor (70), for driving in rotation a drum (2) supported in the tub (6); the electric motor (3) is provided with a control circuit board (100) associated with a heat dissipator (33). The heat dissipator (33) is integrally formed with the support (33).

7 Claims, 6 Drawing Sheets

SUPPORT FOR FIXING AN ELECTRICAL MOTOR TO A TUB OF A WASHING MACHINE OR SIMILAR HOUSEHOLD APPLIANCE

FIELD OF APPLICATION

The present invention concerns a support for fixing an electric motor to a tub of a washing machine or similar household appliance.

More in particular, the present invention refers to a support for fixing an electric motor to a tub of a washing machine or similar household appliance, the electric motor being of external rotor type, for driving in rotation a drum supported in the tub, the electric motor being provided with a control circuit board associated with a heat dissipator.

PRIOR ART

As is well known to those skilled in the art, a washing machine traditionally comprises a tub, within which a drum is housed that is driven into rotation by a belt. The belt is rotated by a pulley integral with the rotor of an electric rotor.

The electric motor is controlled by a control circuit board, comprising electronic circuitry capable of controlling magnitudes related to the motion of the rotor, such as speed and acceleration, and electrical magnitudes, such as voltage and the current of the rotor coils. The electronic circuitry normally comprises power components, for example IGBT, and logic components, for example a microcontroller or a microprocessor, capable of controlling the functioning of the power components.

The control circuit board, due to the large heat dissipation of the power components, requires getting rid of the heat produced by such power components by means of a heat dissipator.

The electric motor, for a washing machine as described above, is in general one of the following two types, according that presented by the prior art:

- electric motor with internal rotor, generally of asynchronous type, or
- electric motor with external rotor, generally of synchronous type with permanent magnets, depending on the mutual position between stator and rotor.

A typical example of an electric motor with internal rotor, for a washing machine, is described as follows. Such electric motor has an internal rotor substantially surrounded by a stator. The stator rotatably supports the internal rotor due to the contribution of two bearings. The stator is typically enclosed by a front flange and by a rear flange. Each of such flanges has two fixing feet, adapted to be fixed to suitable fixing means integral with the tub. In such a manner, from a structural standpoint, the electric motor with internal rotor is supported by the tub on four support points from above. Such fixing is simple, economical and structurally strong.

An electric motor with external rotor for a washing machine, on the other hand, has an external rotor provided with permanent magnets which surround a stator. The stator supports the external rotor due to the contribution of bearings. The stator is supported overhanging, for example due to an axial extension of the stator, which is anchored on the side and not from above.

Therefore, tubs for washing machines with electric motors with internal rotor are different from tubs for washing machines with electric motors with external rotor. Such two tub types are essentially differentiated from each other by only the fixing means, and the positioning of such fixing means in the tubs (in a position below the tub) for the tubs adapted to support motors with internal rotor, in a lateral-rear position for tubs adapted to support motors with external rotor provided with driving belt as reported in the patent application WO 0055414 A1. One category apart is represented by the so-called "direct drive" drive motors in which the rotor is directly fit on the axis of the drum thus lacking driving belt, as reported in the patent applications WO 0070138 A1 and WO 0070139 A1.

It would be advantageous to make both washing machines with electric motor with internal rotor and washing machines with electric motor with external rotor using the same type of tub, and, thus, electric motors for driving the drum which are perfectly interchangeable.

There is also a further need for a decidedly different character of the electric motors with external rotor.

It would in fact be advantageous to reduce the weight and the volume of the components associated with the control circuit board. The presence of the heat dissipator, for example, which is usually of large size, leads to a disadvantageous weight and bulk increase of the components associated with the control circuit board. In addition, one such solution is normally not very reliable, since, due to the unavoidable vibrations in a washing machine, the heat dissipator could be separated from the rest of the control circuit board. Finally, the heat dissipator represents weight increase of the circuit board, such to make its handling difficult during the manufacturing process and to complicate the logistics for the replacement piece market.

The object of the present invention is that of allowing that both washing machines with electric motor with internal rotor and washing machines with electric motor with external rotor employ the same tubs and, at the same time, permitting lower weight and smaller bulk of the components associated with control circuit board, above all regarding the heat dissipator.

SUMMARY OF THE INVENTION

This technical problem is solved by a support for fixing an electric motor to a tub of a washing machine or similar household device, said electric motor being of the external rotor type, for driving in rotation a drum supported in said tub, said electric motor being provided with a control circuit board associated with a heat dissipator, characterised in that it is integrally formed with said heat dissipator.

In this manner, the following two properties are simultaneously ensured:

- the fixing of an electric motor with external rotor to a tub with fixing means typical for supporting an electric motor with internal rotor;
- the contribution, for the control circuit board of the electric motor with external rotor, of a heat dissipator formed integrally with the support.

One characteristic of the present invention, according to which the support comprising stiffening ribs, has the following double object:

- structural, since such stiffening ribs contribute to the support of the electric motor;
- thermal, since such stiffening ribs are capable of dissipating the heat of the control circuit board, thus acting as heat dissipation fins.

The characteristics and advantages of the present invention will be clear from the following description made with reference to the attached drawings, which are given as indicative and non-limiting.

DETAILED DESCRIPTION

Figure 1A:
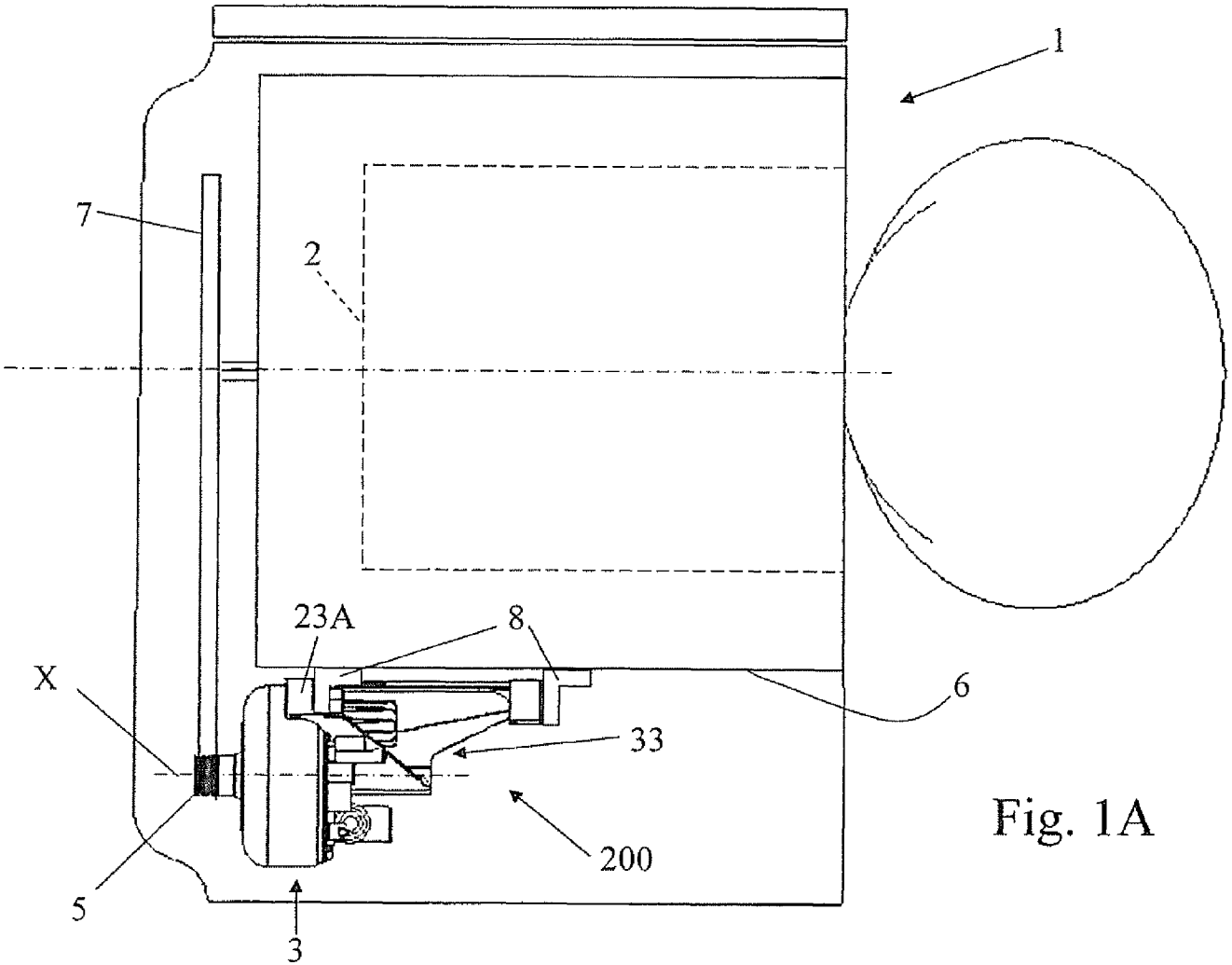
FIG. 1A represents a schematic view of the invention in a washing machine.
Figure 1B:
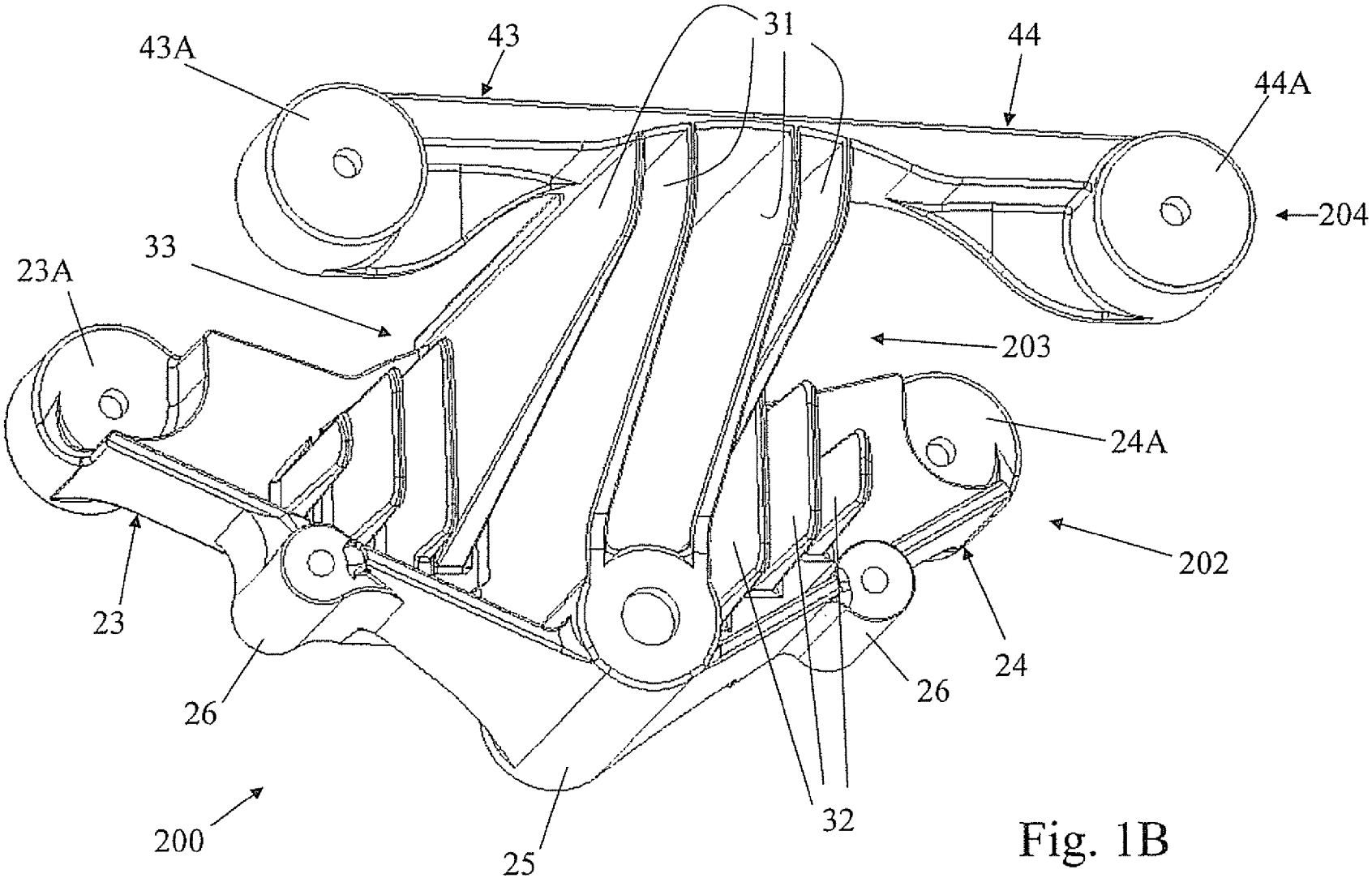
FIG. 1B represents a rear perspective view of the invention.
Figure 2:
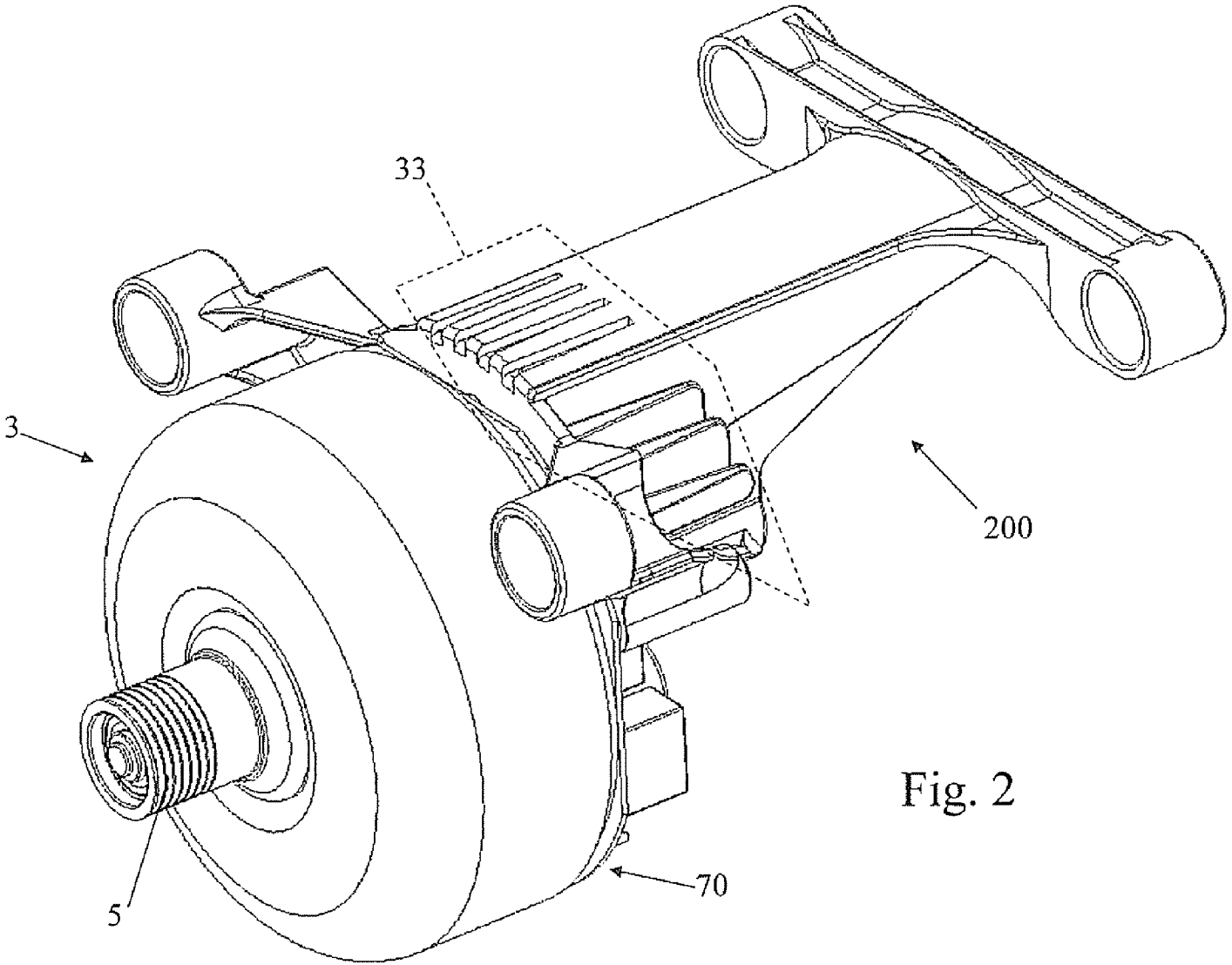
FIG. 2 represents a front perspective view of the invention supporting an electric motor with external rotor.
Figure 3:
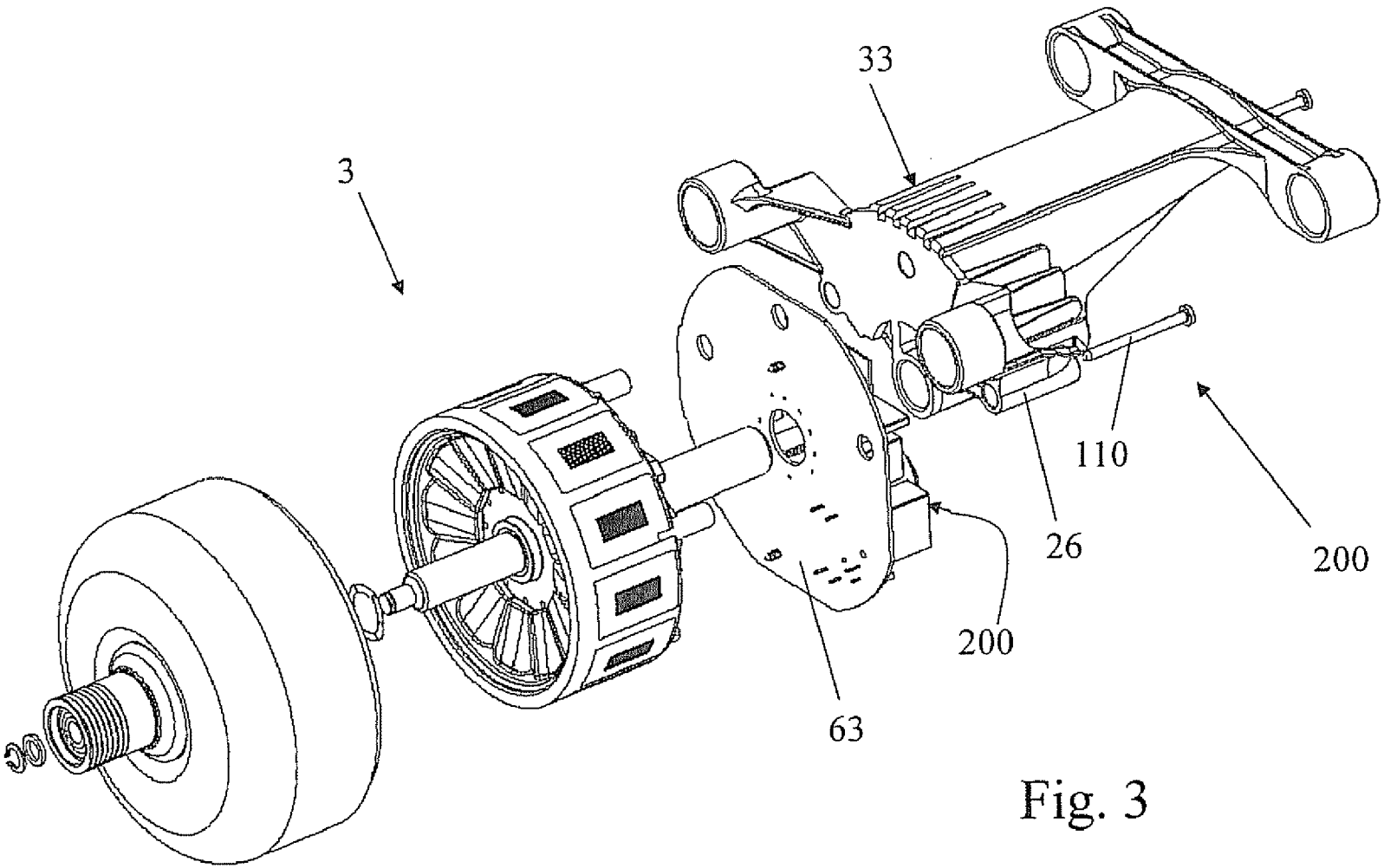
FIG. 3 is analogous to FIG. 2 but in exploded perspective.
Figure 4:
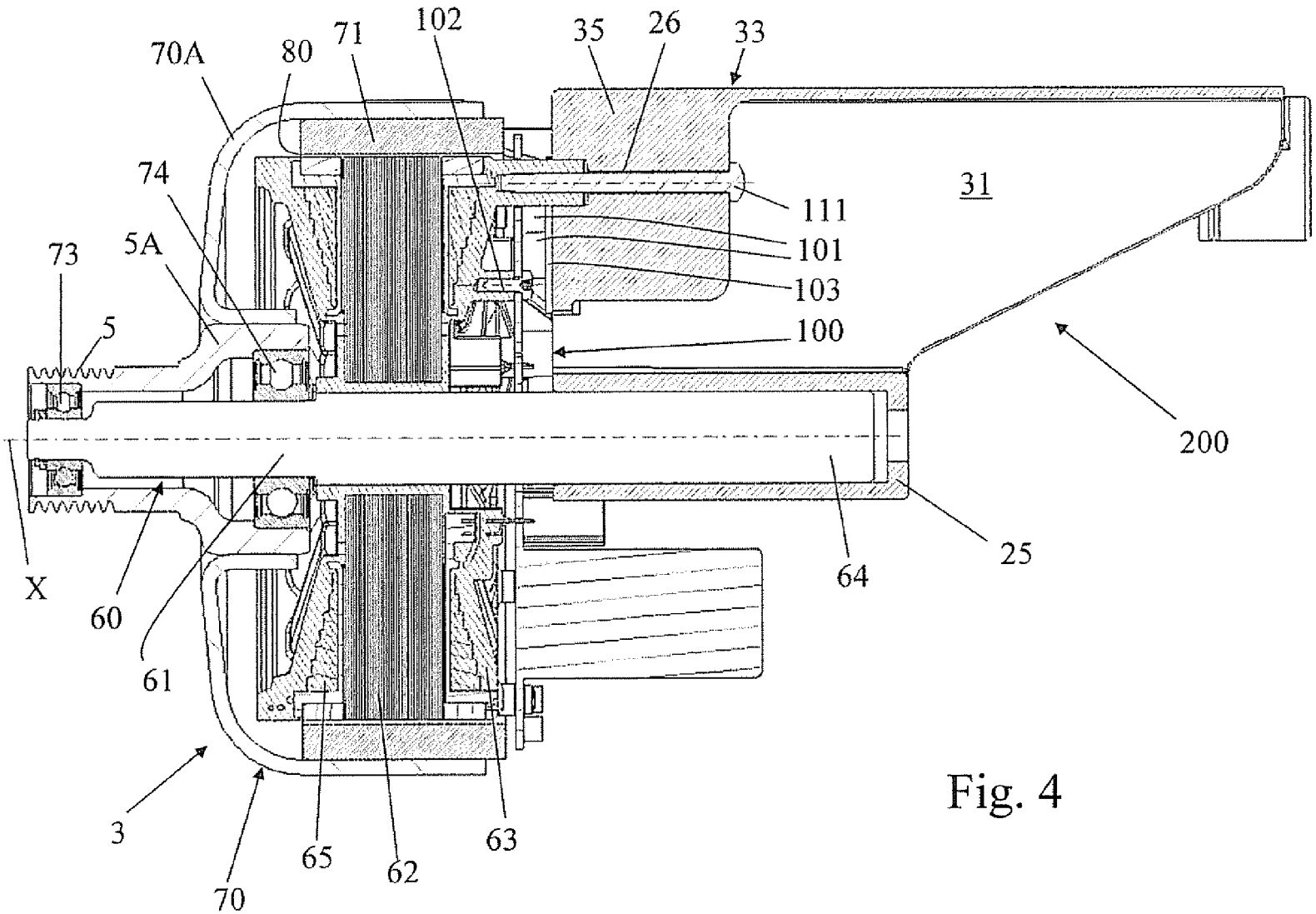
FIG. 4 represents a vertical section view of the invention as in FIG. 2.
Figure 6:
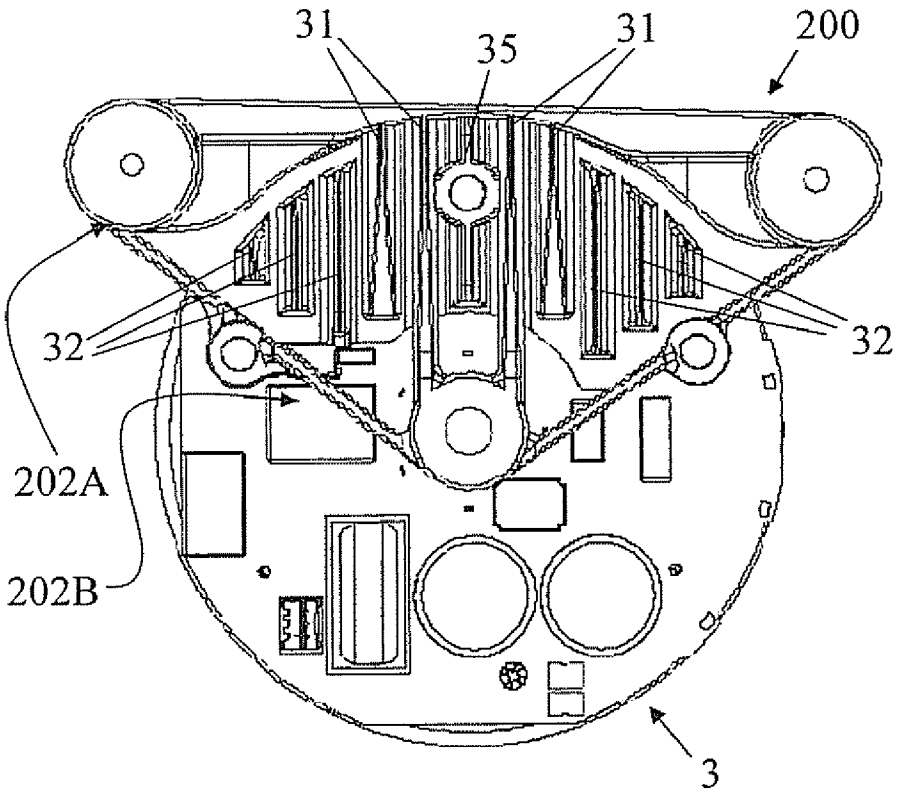
FIG. 6 represents a front view from behind of the invention as in FIG. 2.
Figure 5:
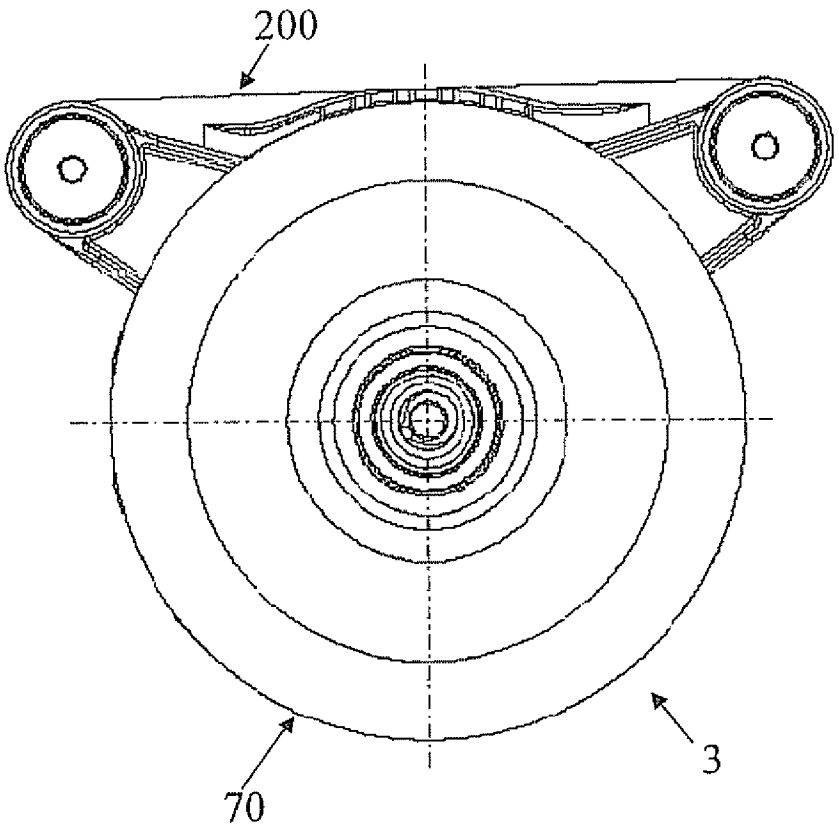
FIG. 5 represents a front view of the invention as in FIG. 2.

A washing machine 1 is represented in FIG. 1A. Such washing machine 1 comprises a tub 6 within which a drum 2 is present, said drum 2 being driven into rotation by a belt 7 moved by a pulley 5 integral with the rotor of an electric motor 3 fixed from above to the tub 6 by means of a support according to the invention.

With reference to FIGS. 1A-6, the support 200 is indicated in its entirety. Such support 200 is intended to carry out a sustained function of the electric motor 3 with external rotor. In turn, the support 200 is supported by the tub 6, which is provided with fixing means 8 of the type traditionally capable of supporting a motor with internal rotor.

The support 200 is integrally formed of thermally conductive material, preferably a light alloy, in particular an aluminium alloy. Other embodiments can provide for a thermally conductive plastic material. Advantageous, such support 200 is obtained by means of pressure die-casting. Such support 200 has a substantially H structure, with a longitudinal core 203, a front flange 202 and a rear flange 204.

The front flange 202 has feet 23 and 24 respectively with eyelet ends 23A and 24A. The rear flange 204 has feet 43 and 44 respectively with eyelet ends 43A and 44A. Such eyelets 23A, 24A, 43A and 44A are fixing means adapted to be fixed to the tub of the washing machine, by means of counter-eyelets 8, in se known (for example, conventionally adapted to support an electric motor with internal rotor), integral with the tub 6 and projecting therefrom.

The rear flange 204 is only extended in raised position. On the other hand, the front flange 202 is extended in the following portions:

- a raised position portion 202A, at the same level as the rear flange 204, such that the four feet are coplanar;
- a lowered position portion 202B, supported by the raised portion of both the flanges 202 and 204.

The front flange 202 also incorporates, in lowered central position 202B, a hollow cylindrical element 25, capable of housing the end of a cylindrical body.

In addition, the front flange 202 incorporates hollow cylinders 26 capable of housing screws, thus acting as fixing means.

The longitudinal core 203 is of form comprising stiffening ribs 31. Such stiffening ribs 31 have structural functions, since they support the lowered portion of the front flange 202, but they are also capable of exchanging heat with the outside, so as to function as heat dissipation fins, forming a heat dissipator 33. Such heat dissipator 33 also comprises lateral fins 32 with only heat dissipation function, no structural function. At its interior, the dissipator 33 comprises a further fin 35 shaped so as to receive a screw. In addition, the dissipator 33 comprises reliefs 36 alternated with notches 37 in an upper external position.

The electric motor 3 is illustrated below.

Such electric motor 3 is of synchronous type with external rotor with permanent magnets capable of rotating around the longitudinal axis X.

The stator 60 of the electric motor 3 comprises a pin 61 in the form of adjacent cylinders coaxial with an X axis, around which a plurality of per se known pole pieces 62 are present, defined by a plurality of equivalent stacked and fixedly mounted plates. The pole pieces 62 are wound with coils 65 in a known manner. The stator 60 is incorporated by a plastic over-moulding 63. It is to be observed that the right end 64 of the pin 61 represents a substantial axial extension of the stator 60.

The rotor is indicated with 70. It comprises permanent magnets 71 separated from the pole pieces 62 of the stator 60 by interposition of an air gap 80. The rotor, also comprising a central boss 5A fit with interference on cup-shaped cylindrical body 70A, is capable of rotating around the X axis, supported by the stator 60 by means of suitable bearings 73 and 74.

The rotor 70 is integral and capable of making the pulley 5 rotate, such pulley 5 integrally made from the boss 5A and rotating around the pin 61 and the X axis.

The rotation of the rotor 70 is controlled by a control circuit board 100 capable of controlling the velocity of the rotor 70 by means of inverter control, in se known, of electrical voltage, current and frequency magnitudes of the coils 65.

The control circuit board 100 comprises electronic circuitry necessary for controlling magnitudes related to the rotor motion, in particular the speed, and the electrical magnitudes, such as the voltage and the current which affect the rotor coils. The electric circuitry normally comprises power components such as known IGBT 101 in contact with a metal plate 103.

Contrary to the control circuit boards according to the prior art, the control circuit board 100 does not comprise its own heat dissipator for the heat removal. Nevertheless, such heat removal is in any case carried out, as will be seen below.

The coupling of the electric motor 3 with the support 200 is described below.

Within the cavity of the hollow cylindrical element 25, the end of the pin 61 is inserted such that the support 200 is capable of supporting the electric motor 3.

The control circuit board 100 is interposed between the electric motor 3 and the support 200, fixed by means of the following fixing elements:

- screws 102 to fix the control circuit board 100 to the over-moulding 63;
- screws 110 inserted in the hollow cylinders 26 and fixed to the over-moulding 63;
- a screw 111 received in the central fin 35 and fixed to the over-moulding 63.

A pressing contact is obtained between the control circuit board 100 and the heat dissipator 33.

Based on the type of coupling achieved, the control circuit board 100, by means of the metal plate 103, is associated with the stiffening ribs 31 and with the fins 32 and 35: in this manner, the heat produced by the IGBTs 101 is conveyed to the metal plate 103 and afterward to the stiffening ribs 31, to the fins 32 and 35, to the reliefs 36 and to the notches 37.

It is observed how a heat dissipator 33 is obtained from the stiffening ribs 31, which do not only have thermal purpose, but also at the same time structural purpose, as they support the electric motor 3.

Thus, the control circuit board 100 is in contact with the heat dissipator which is incorporated with the support 200: advantageously, the control circuit board 100 does not require its own heat dissipator, as in the prior art, but exploits that essentially formed by the stiffening ribs 31 of the support 200.

Thus, the stiffening ribs, which have the structural task of supporting the electric motor, advantageously have the further task of exchanging heat with the outside environment. Thus, rather than construct a support capable of supporting a control circuit board with its own heat dissipator, it is possible to use only one support with the further heat dissipation function. Without an actual heat dissipator of the control circuit board, moreover, the same board weighs less, thus requiring a support with less material.

In addition, such support allows the further advantage of being a good heat carrier, being made of thermally conductive material.

Thus, the present invention is capable of combining production advantages (due to the possibility to use the same tub for different types of electric motors) with the heat removal and structural advantages presented above.

The invention claimed is:

1. A support for fixing an electric motor to a tub of a washing machine or similar household appliance, the electric motor being of an external rotor type, for driving in rotation a drum supported in the tub, the electric motor being provided with a control circuit board wherein the support comprises:

an upper portion comprising fixing means adapted to be fixed to the tub of the washing machine or similar household appliance;

a front flange adapted to be fixed to the electric motor, said front flange comprising a lowered portion; and stiffening ribs connecting the lowered portion of the front flange to the upper portion of the support, in such a way as to structurally support said lowered portion, said stiffening ribs being associatable with the control circuit board of the motor in such a way as to perform a heat dissipation function for said control circuit board.

2. The support according to claim 1, wherein the support is composed of thermally conductive material.

3. The support according to claim 2, wherein the support is composed of light alloy.

4. The support according to claim 3, wherein said light alloy is aluminum alloy.

5. The support according to claim 1, wherein the support is made via pressure die-casting.

6. The support according to claim 1, wherein the support comprises an element provided with a cavity adapted to receive and support an axial extension of a stator of the motor.

7. The support according to claim 1, wherein the control circuit board is interposable between the electric motor and said support.

* * * * *